United States Patent [19]

Brien

[11] 3,963,885

[45] June 15, 1976

[54] GRAVITY ACTUATED MINIATURE SWITCH FOR WATCH HAVING SWITCH ACTUATOR MAGNETIC RETAINING STRUCTURE

[76] Inventor: Andre Guy Brien, 3110 Germain St., Fabreville, Quebec, Canada

[22] Filed: Feb. 4, 1975

[21] Appl. No.: 547,042

Related U.S. Application Data

[63] Continuation-in-part of Ser. No. 438,165, Jan. 30, 1974, abandoned.

[52] U.S. Cl. ..... 200/52 R; 58/50 R; 200/61.45 M; 200/61.52; 200/61.58 R; 200/85; 200/DIG. 18; 200/DIG. 29

[51] Int. Cl.[2] ..... H01H 35/02; G04C 23/00

[58] Field of Search ..... 200/1 R, 17 R, 19 R, 200/33 R, 52 R, 61.11, 61.45 R, 61.45 M, 61.52, 61.58 R, 61.62, 61.83, DIG. 8, DIG. 18, DIG. 29, 85 R; 58/23 R, 23 BA, 50 R

[56] References Cited

UNITED STATES PATENTS

| | | | |
|---|---|---|---|
| 2,716,168 | 8/1955 | Shonka | 200/61.52 X |
| 2,744,976 | 5/1956 | Black | 200/61.45 M UX |
| 2,761,925 | 9/1956 | Gray | 200/61.11 |
| 2,854,537 | 9/1958 | Sternburgh | 200/52 R X |
| 2,898,416 | 8/1959 | Clurman | 200/61.45 M |
| 2,946,867 | 7/1960 | Wehrig | 200/61.52 X |
| 2,965,738 | 12/1960 | Naxon | 200/52 R X |
| 2,997,557 | 8/1961 | Gillmor et al. | 200/61.52 X |
| 3,466,045 | 9/1969 | Walton | 200/61.11 X |
| 3,470,338 | 9/1969 | Ahrens | 200/52 R X |
| 3,729,923 | 5/1973 | Brigliano et al. | 58/23 BA X |
| 3,742,699 | 7/1973 | Bergey | 58/50 R |
| 3,748,847 | 7/1973 | Kouchi | 58/50R |
| 3,823,285 | 7/1974 | Dwyer | 200/DIG. 29 X |

*Primary Examiner*—James R. Scott

[57] ABSTRACT

A switch device for use in a wristwatch. The device comprises a switch housing and a cavity defined within the switch housing. The cavity has a side wall with at least a portion thereof being arcuately extending, a top wall and a bottom wall. A spherical displaceable element, of magnetically attractable material, is located for movement within the cavity. The side wall, top wall and bottom wall are spaced apart a distance sufficient to permit free displacement of the displaceable element therebetween. At least one magnetic element is associated with the cavity and located in a portion of the side wall whereby to retain the spherical displacement element thereto by magnetic attraction when the spherical element is displaced thereagainst in the cavity. The spherical element, when retained by the magnetic element, is dislodged therefrom by an external force created by a predetermined movement of a wearer's arm to release the spherical element in the cavity by gravity. Switch contact means is provided in the arcuately extending portion of the side wall and actuable by the spherical displaceable element when in contact therewith and when the wristwatch is in a particular position.

12 Claims, 12 Drawing Figures

GRAVITY ACTUATED MINIATURE SWITCH FOR WATCH HAVING SWITCH ACTUATOR MAGNETIC RETAINING STRUCTURE

This is a application is a continuation-in-part of U.S. application, Ser. No. 438,165, filed Jan. 30, 1974 now abandoned.

BACKGROUND OF INVENTION a. Field of the Invention

The present invention relates to a gravity actuated switch and more particulary, but not exclusively, to a miniaturized switch for use in a wristwatch.

b. Description of Prior Art

Heretofore, there existed the need for a means to actuate an electric lamp bulb secured in a wristwatch whereby to illuminate the face of a wristwatch or an aperture or digital readout numbers on the face of the wristwatch to make the face of the watch visible in the dark or simply to illuminate time display elements. Various types of switching devices have been provided in wristwatches to connect a small dry cell battery to a lamp. One such known switch device is a pressure switch operated by wrist movement which causes actuation of the switch. A disadvantage of this type device is that the watch strap must have the proper tightness and must be in a specific position about the wrist to transmit a pressure to the switch for operation. Depending on the shape of the person's wrist, it may be difficult to operate these devices. Other types of prior art switch devices incorporate sliding contacts or movable dry cells which are held in the watch casing. These switch structures require larger size watch casings and are often activated by normal arm movement, thus imposing unnecessary current drain on the battery and causing the lamp bulb to illuminate too frequently when not required.

SUMMARY OF INVENTION

It is, therefore, a feature of the present invention to provide a switch which substantially overcomes all of the above-mentioned disadvantages.

It is a further feature to provide a switch which will connect power to a lamp bulb substantially only when placed in a particular position to reduce accidental and unnecessary actuation of the switch.

It is a further feature to provide a switch which is of small size and which can be installed in the casing of conventional wristwatches.

According to the above-mentioned features, from a broad aspect, the present invention provides a switch device for use in a wristwatch. The device comprises a switch housing and a cavity defined within the switch housing. The cavity has a side wall with at least a portion thereof being arcuately extending, a top wall and a bottom wall. A spherical displaceable element, of magnetically attractable material, is located for movement within the cavity. The side wall, top wall and bottom wall are spaced apart a distance sufficient to permit free displacement of the displaceable element therebetween. At least one magnetic element is associated with the cavity and located in a portion of the side wall whereby to retain the spherical displacement element thereto by magnetic attraction when the spherical element is displaced thereagainst in the cavity. The spherical element, when retained by the magnetic element, is dislodged therefrom by an external force created by a predetermined movement of a wearer's arm to release the spherical element in the cavity by gravity. Switch contact means is provided in the arcuately extending portion of the side wall and actuable by the spherical displaceable element when in contact therewith and when the wristwatch is in a particular position.

BRIEF DESCRIPTION OF DRAWINGS

An embodiment of the present invention will now be described with reference to the accompanying drawings in which.

DESCRIPTION OF PREFERRED EMBODIMENTS

Figure 1:
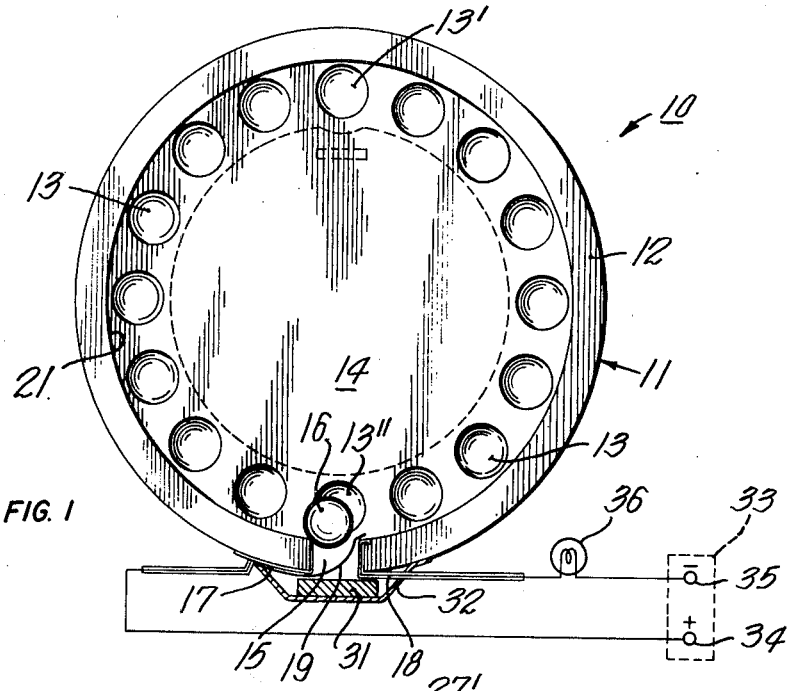
FIG. 1 is a plan view of the switch casing of the present invention.
Figure 2:
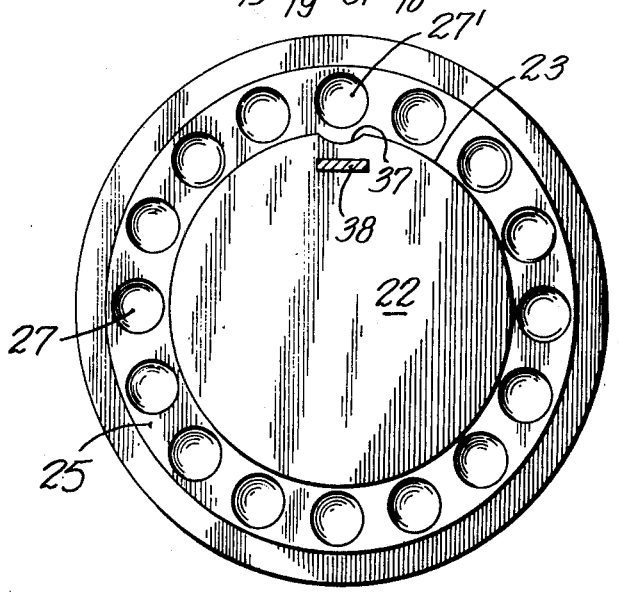
FIG. 2 is a plan view of the switch cover.
Figure 3:
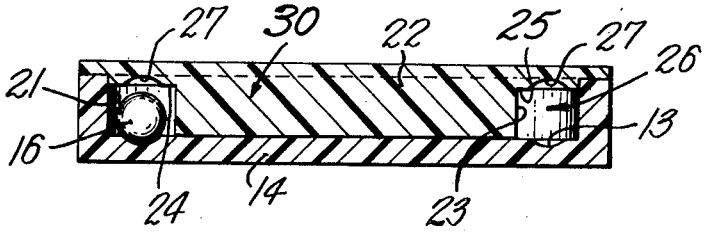
FIG. 3 is a cross-sectional view of the assembled switch.

Referring now to the drawings, and more particularly to FIGS. 1 to 3, there is shown generally at 10, an embodiment of the miniaturized switch device of the present invention. The switch 10 comprises a flat, wafer-like housing 11 of generally circular shape defining a back wall 14 and a vertical outer side wall 12. A plurality of concave circular cavities 13 are formed in the back wall 14 and spaced apart adjacent the outer side wall 12 along the entire circumference of the housing 11. An opening or cavity 15 is also provided in the inner surfaces 21 of the outer side wall 12 and being of smaller size than the diameter of a spherical displaceable element, herein a ball 16 adapted to coact therewith in a manner as will be described later. A first and second electrical contact, 17 and 18 respectively, are positioned each on a respective side of the opening 15. A leaf spring switch arm 19 is secured to the first contact 17, or may be formed integral therewith, and extends across the opening 15 and has a free end 20 positioned normally adjacent and in close proximity to the second contact 18. The cover plate 30 of the switch housing 11 is comprised of a circular disc having a protruding central portion 22 defining an inner side wall 23, and a flange portion 24 defining the top wall 25 of a channel or passage means 26. Although not essential, the top wall 25 may also be provided with concave cavities 27 to support the ball 16 therein when the casing is upside down. The cross-section of the channel 26 is of suitable size to permit the ball 16 to move therein in and out of the cavities 13.

A magnet 31 is located in a housing 32 secured to the outer side wall 12 and opposite the opening or cavity 15. The purpose of the magnet 31 is to attract the metallic ball 16 sufficiently to cause the spring contact arm 19 to bend to form a closed circuit across the contacts 17 and 18. If the ball 16 is heavy enough, the magnet 31 may not be required as the weight of the ball 16 will be sufficient to cause the arm 19 to bend and close the circuit.

As can be seen from FIG. 1, the circuit comprises a battery 33 having a first terminal 34 thereof, herein the positive terminal, connected directly to the contact 17, and a second terminal 35, the negative terminal, connected to the contact 18 via a series connected lamp bulb 36. When the contact arm 19 closes the circuit across both contacts 17 and 18, current will flow through the lamp bulb 36 and cause it to light.

As shown in FIG. 2, a small concave recess 37 may be provided in the inner side wall 23 of the channel 26, that is to say, in the side wall of the central portion 22. The recess 37 is positioned remotely and along the central axis of the opening 15 whereby to receive the ball 16 therein when the ball is resting in the cavities 13' and 27' adjacent thereto and the plane of the switch housing 11 is positioned substantially along a vertical plane. This provisional feature further minimizes accidental actuation of the contact 19 during normal hand movement. A magnet 38 may be embedded in the cover adjacent the recess 37 to retain the ball 16 therein and to release it when the housing 11 is displaced away from the vertical plane. This acts as a retarding means for the ball when in that position.

A further feature of the switch device is to vary the shape of the concave surface of the cavity 13'' positioned adjacent the opening 15 to control the ease of movement of the ball 16 from the cavity 13 to the opening 15 upon displacement of the housing 11.

The housing 11 and its cover 30 may both be made from a suitable plastic material. In the present embodiment the ball 16 is made of a steel or a suitable metal for depressing the contact arm 19. The ball may also be used for bridging the two contacts 17 and 18 acting itself as a conductor and eliminating the necessity of contact 19. In the case where there is provided a contact arm 19, the ball 16 may be made of other suitable materials provided it has sufficient weight to depress the arm 19 to close the contacts. Thus, the magnet 31 would not be required. Also, the housing 11 may be formed as a circular hollow ring instead of wafer-like housing.

In practice and operation, the switch housing 11 is secured within a wristwatch casing (not shown) with the plane of the housing 11 parallel or slightly rearwardly inclined to the plane of the wristwatch. In the preferred application, the opening 15 is on the thumb side of the hand i.e. at 6 o'clock on the watch dial. By turning the hand and wrist (not shown) so that the face of the watch lies substantially in a vertical plane, the ball 16 will move to the lowermost part of the channel 26 adjacent and into the opening 15 resting on the arm 19 and causing a closed circuit condition between contacts 17 and 18 and the lamp 36 to light.

The above-described embodiment may be utilized in mechanical wristwatches and solid state watches employing liquid crystal or light emitting diode display. Some advantages of the present invention is that it is not required to have expensive watch casings for housing the switch and permits the watch casing to be smaller and maintain its aesthetic appearance. The invention does not require a special watch band for its actuation. Further, the switch may be injection molded in the watch casing and is easily operated and substantially minimizes accidental actuation. Also, it is within the ambit of the present invention to provide known electric circuit means whereby when the ball engages the contact, the circuit means is "switch on" which in turn causes the lamp to light for a predetermined period of time. Thus, the ball may only act as a triggering means to switch the circuit means.

Figure 5:
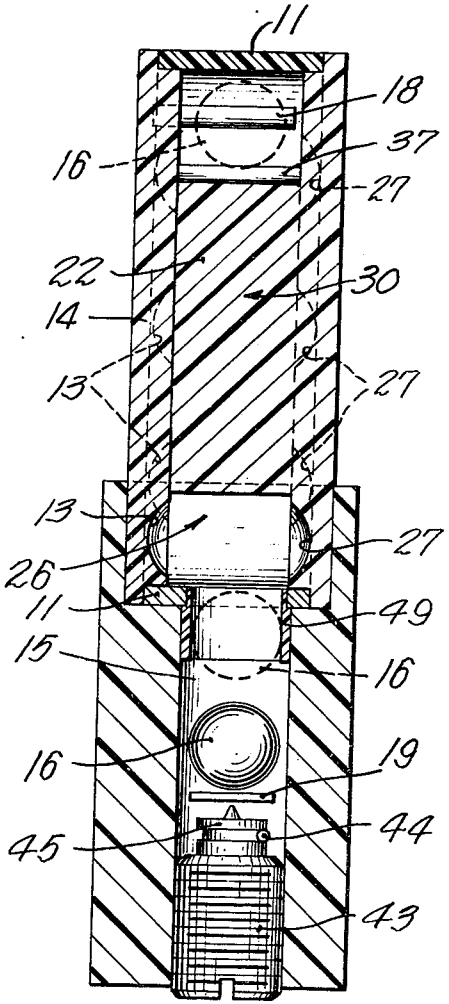
FIG. 5 is a sectional side view of the switch of FIG. 4.
Figure 4:
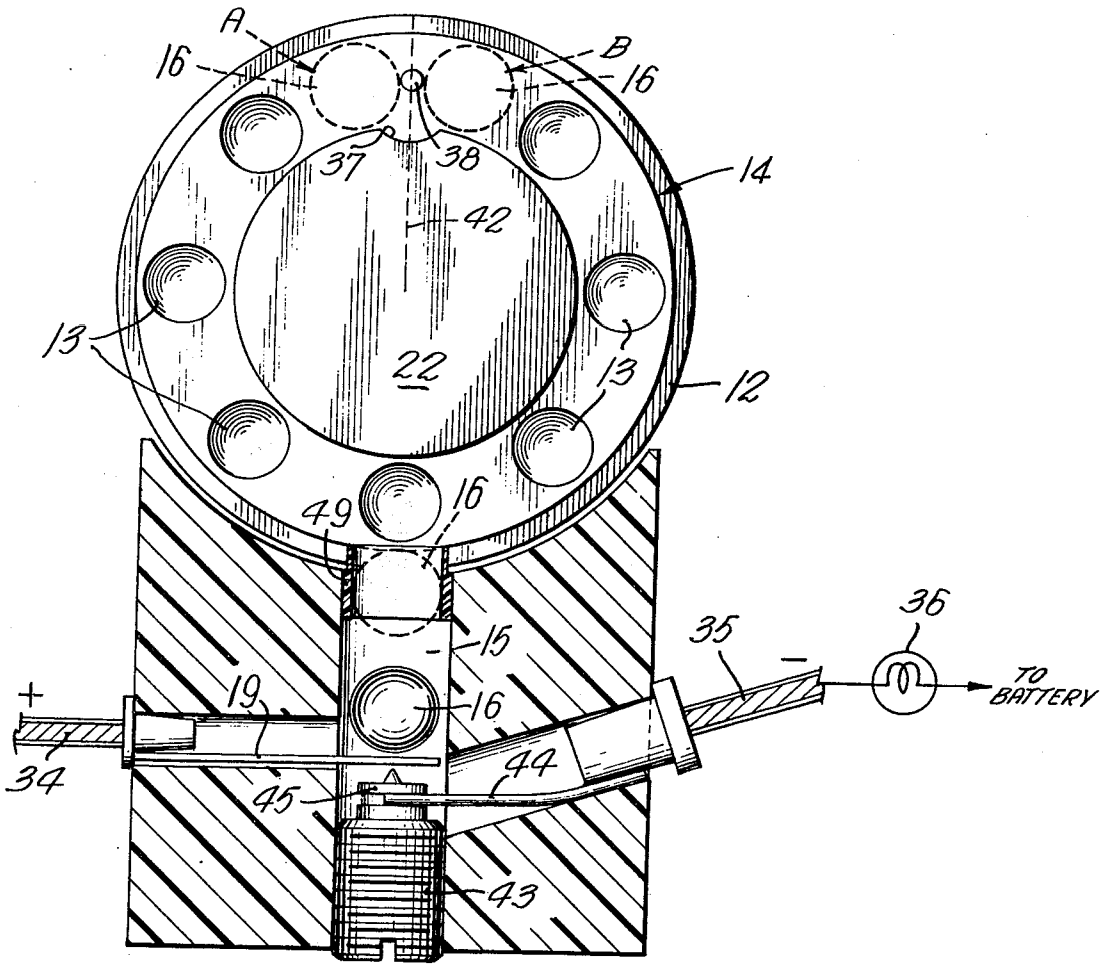
FIG. 4 is a sectional plan view of a further embodiment.

Referring now to FIGS. 4 and 5, there is shown a still further embodiment of the present invention. As herein shown, the channel 26 is provided with fewer circular cavities 13 than in the previous embodiment because of the small diameter of this switch. In the upper part of the channel 26 there is provided a post 38 of magnetic material. One side of the post 38 may have a stronger magnetic field than the other side. The reason for this is that when the metal ball 16 is on the left side of the post, position "A", there is more retention of the ball to the post. This is necessary because when a person is sleeping (motionless) the ball 16 will normally lie in this position because of the most common position of the arm at rest. When the ball is on the other side of the post, position "B", there is less magnetic attraction to the ball and this is a position where the ball will be most frequently during normal movement of the arm during the period of time that the person is active.

A recess 37 is also provided, as in the previous embodiment. However, this recess is offset from the radius 42 passing through the centre of the post 38. The reason for this recess 37 being offset is that when the ball 16 is in position "A", the central axis of the ball will lie on the outer edge of the recess 37 and thus has more support from the central portion 22. As can be seen, when the ball is in position "B" there will be less support, thus making it easier to dislodge the ball from this position.

In the embodiment as shown in FIGS. 4 and 5, it is seen that the cavity 15 in the inner surface 21 of the outer side wall 12 is substantially deeper and forms a channel whereby the contact is located remotely from the inner surface 21. Therefore, when the ball 16 enters the cavity 15, it will drop into the channel and rest on the spring switch arm 19 located therein. This switch arm 19 is connected to an electrical wire 34 leading to the positive terminal of the battery. Below the switch arm 19 there is provided an adjustable contact 43 constituted by a threaded shank. As shown, a wire 34 is conveniently connected to the adjustable contact 43 and to wire 35, which in turn connects to a lamp terminal having its other terminal connected to the negative terminal of the battery. Thus, when the ball 16 engages the switch arm 19, a contact is made between the switch arm 19 and the head 45 of the contact 43 to cause the lamp 36 to light. Of course, the wire could also be connected to the contact 43 in a different manner than illustrated in this drawing. It can be seen that with this adjustable contact arrangement the sensitivity of the switch can be easily adjusted. All that is required to be done for adjustment is to cause the ball 16 to lodge itself into the channel and rest on the switch arm 19. With the ball in this position, the contact 43 is threaded into its bore until the lamp 36 lights. This means that the head 45 of the shank has come into contact with the arm 19. After this adjustment, it is preferable to cause the ball 16 to move out of the cavity 15 to verify if the lamp is still lit. If it is lit, then the adjustment shank 43 is turned in the other direction very slowly until the lamp is extinguished. This will give the position of most sensitivity. Another feature of the switch is shown in FIG. 5 and namely it is noted that the channel or cavity 15 is positioned to one side of the channel 26. This creates a ledge 49 on one side of the cavity which further restricts the ball 16 from entering the cavity 15 when the person wearing the watch is inactive, i.e. during sleep. During this inactive period the ball 16, in the majority of this time will be on the left side of the channel 26 adjacent to the ledge 49.

Figure 6:
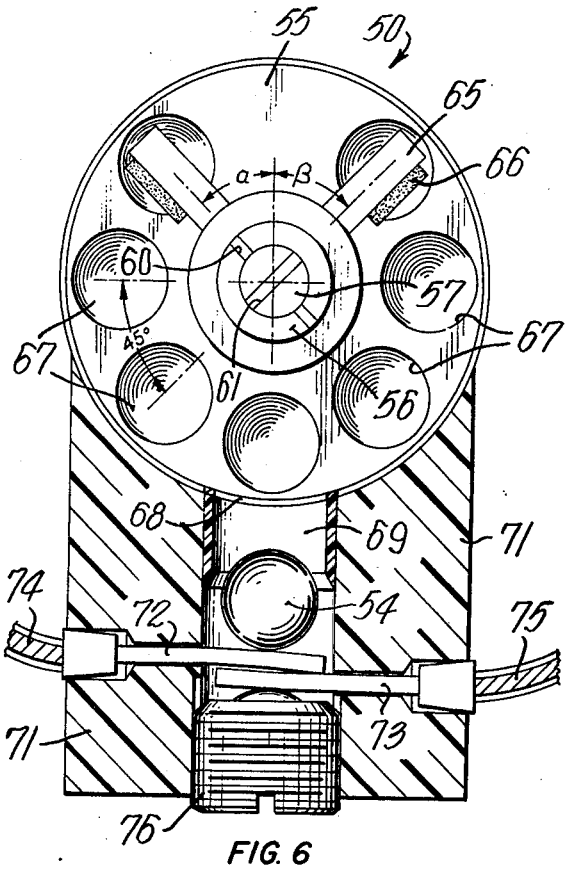
FIG. 6 is a sectional plan view of a further embodiment of a switch constructed in accordance with the present invention.
Figure 7:
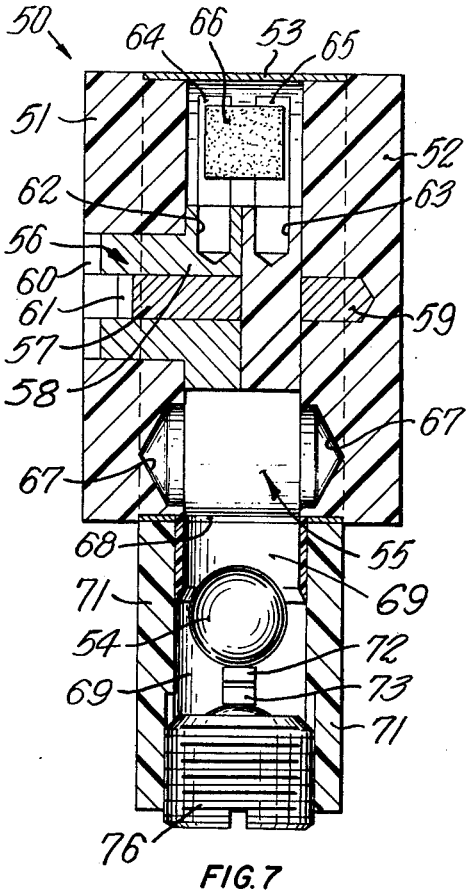
FIG. 7 is a fragmented side view of the switch of the type shown in FIG. 6.

Referring now to FIGS. 6 to 8, there is shown a still further embodiment of the present invention. Herein shown, the housing 50 is formed by two circular plastic walls 51 and 52 held spaced apart by a circular connecting ring 53.

The ball 54 moves in the housing 50 and eventually, by virture of its weight, closes the circuit. The ring 53 and the walls 51 and 52 form an empty cylindrical space or passage means 55. In the center of this passage, there are two cylinders 56 and 57. The space between the ring 53, walls 51 and 52 and the cylinders 56 and 57, is a square section circular channel 55 in which the ball 54 may move.

Cylinders 56 and 57 have each their own shaft 58 and 59. The shaft 59 of cylinder 57 is inside the shaft 58 of cylinder 56. The shafts are slotted at 60 and 61, so as to allow them to be rotated by means of a screw driver (not shown). Each cylinder has a radial hole 62 and 63 which holds a support pin 64 and 65 supporting a respective magnet 66. These two pins or magnets are at angles $\alpha$ and $\beta$ respectively from position 12:00 o'clock on a watch dial 70 (see FIG. 8A). It can thus be seen that the position of the magnets is adjustable.

Preferably, each wall 51 and 52 bears seven cavities 67. These cavities are in positions 1:30, 3:00, 4:30, 6:00, 7:30, 9:00 and 10:30 of the watch dial (see FIG. 8A). The diameter of ball 54 is slightly smaller than the diameter of cavities 67.

The wall of the ring 53 has a hole 68 to allow the ball to move out of the channel 55. The hole 68 is positioned at 6:00 o'clock relative to the dial 70. Under the hole 68, there is a cylindrical hole or chute 69 which is located in an extension 71 of the housing 50.

The switch contact arms 72 and 73 are connected to two wires 74 and 75, respectively, which are in turn connected to a battery and bulb as previously described. These arms are cantilevered in the wall of the extension 71 adjacent the chute 69 into which the ball 54 may fall. When the ball 54 falls in the chute 69, it bends the top arm 72 which then comes in contact with the bottom arm 73. These metallic arms are resistant to the corrosive action of the sparking taking place between them. An adjusting screw 76 is threaded at the bottom of the cylindrical chute 69 and serves to adjust the sensitivity of the device, in a similar manner as described above relative to FIGS. 4 and 5.

Figure 8A:
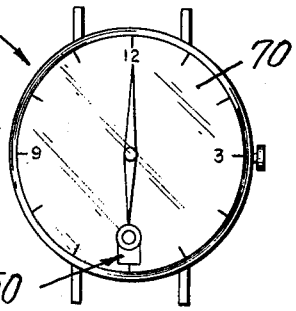
FIGS. 8A and 8B are front and side views, respectively, of a wristwatch showing the position of the switch device.
Figure 8B:
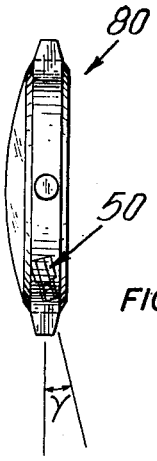

As shown in FIGS. 8A and 8B, the switch 50 is secured at angle $\gamma$ with the plane of the watch 80 and is inserted at the 6:00 o'clock position. This switch could be inserted anywhere in the watch or the bracelet as long as the relative position between the chute 69 and the 6:00 o'clock position on the dial 70 is maintained.

When it is desired to light the front face or dial 70 of the watch 80, the forearm is placed in a horizontal plane with the palm facing downwardly. With a short, quick motion, the wrist is rotated to bring the watch dial to an inclined position with the 12:00 o'clock position on the dial lying in a plane which is above the 6:00 o'clock position so that the ball will fall into the cylindrical chute 69 and come to rest on the upper switch arm 72 to close the circuit between the arms 72 and 73, thus causing the lamp to light. Prior to the short, quick motion of the wrist, the ball 54 was most likely adhered to one of the two magnets 66. The jerky rotation of the wrist freed the ball from it and caused it to move, by gravity, downwardly into the channel 55 and into the chute 69 to cause the contact arms to touch.

The switch device of the present invention has been constructed to reduce the number of accidental switching operations which can take place due to the normal day-to-day movement of the arm. For example, when the hand is hanging from the shoulder, it can be noted that the ball will move to the 3:00 o'clock position on the face dial and thus the ball will most likely be engaged by the magnet to the right-hand side of the switch as illustrated in FIG. 6 or in the cavity 67 which is closely spaced thereto. When the arms are crossed on the front or on the back of the body, the watch is merely horizontal or with the 12:00 o'clock position located slightly lower than the 6:00 o'clock position. Again, the ball will not enter the chute and activate the switch. When the hand is on the face or on the head, the ball tends to move to the 9:00 or 10:00 o'clock position and will either engage with the magnet on the left-hand side of the switch or rest in the cavities adjacent thereto. When the left hand is on the right side of the body, in the front or the back of the person, the thumb is usually pointing upwards and the ball 54 will tend to move towards position 11:00, 12:00 or 1:00 o'clock depending on whether the hand is near the shoulder, the waist, or the knee, respectively. Again, it can be seen that the ball will not enter the chute and activates the switch. When the body is lying on the back and the hand is on the forehead with the palm upwards, the ball tends to move towards the 6:00 or 12:00 o'clock position. However, the magnet and the angular position ($\gamma$) and the cavities in the switch device prevents the ball from moving to the 6:00 o'clock position. The possibilities of a light "on" condition in this position are very slight. When the person is standing up and the hand is on the back of the neck, the ball tends to move to the 6:00 o'clock position. However, in most likelihood, before the hand was displaced at this position, the ball was most likely being engaged with one of the magnets. If there is no jerky movement of the wrist, the ball should be maintained in that position and not be released into the channel and into the chute 69. Thus, it can be seen that to release the ball from the magnets, it is necessary to have this jerky rotation of the wrist.

As mentioned hereinabove, the magnets are secured to the cylinders 56 and 57 which can be rotated on their axis. Thus, the angles $\alpha$ and $\beta$ may be changed to alter the sensitivity of the release of the ball. If the magnetic strength is required to be changed, then magnets of different strengths may be used.

Figure 9:
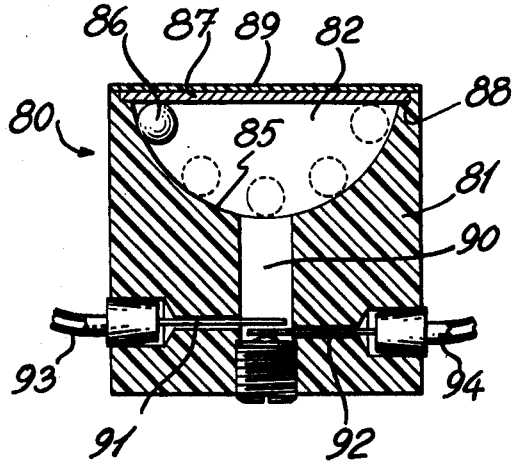
FIG. 9 is a sectional side view of a further embodiment of the present invention.
Figure 10A:
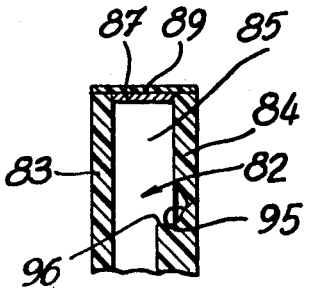
FIGS. 10A and 10B are fragmented views of further modifications of the switch.

Referring now to FIGS. 9 and 10A, there is shown a still further embodiment of the present invention. The switch device 80 is hereinshown as comprising a housing 81 with a cavity 82 defined within said housing 81. The cavity 82 has a top wall 83, a bottom wall 84, and a side wall 85 with at least a portion thereof being arcuately extending. A spherical element 86, of magnetically attractable material, is located for movement within the cavity 82. A magnet 87, of selected magnetic strength, forms a further portion of the side wall 85 of the cavity 82. The magnet 87 is retained between a shoulder 88 formed in the top part of the housing 81, and a cover 89 secured to the top wall of the housing.

The magnet 87 can be secured by other suitable means obvious to a person skilled in the art. Similarly to FIG. 6, a cylindrical hole or chute 90 extends in the housing from the side wall 85. The axis of the chute 90 is aligned along the 6:00 o'clock position relative to the dial 70 as shown in FIG. 8A. The switch 80 would be mounted in a similar manner as the switch 50 shown in FIG. 8A. The hole or chute 90 may also be of the type shown in FIG. 1.

Two switch contact arms 91 and 92 are positioned in the chute 90 and connected to two wires 93 and 94, respectively, which are in turn connected to a battery and bulb as previously described with reference to FIG. 1. The contact arms 91 and 92 are of the type shown and described relative to FIG. 6 and the operation of these switch contact arms with respect to the ball 86 is the same as described relative to FIG. 6.

A plurality of cavities 95 may also be provided in the bottom wall 84 of the housing as more clearly shown in FIG. 10A. These would be arranged in a similar manner to that as shown in FIG. 6 and for the same purpose. Also, as shown in FIG. 10A, a ledge 96 may be provided at least adjacent the chute 90 to provide obstruction to the ball 86 in instances where the ball is freely moving in the cavitty 82 and it is not required to activate the switch contacts. This type of situation could arise when a person is resting and the ball is not engaged with the magnet. If the arm is displaced only slightly, the ball may travel along the arcuate side wall and engage within the cavities 67, if provided.

In operation, the ball 86 is normally resting against the magnet 87 due to the magnetic attraction thereof. In order to activate the switch by causing closure of the switch contact arms 91 and 92, it is necessary to dislodge the ball 86 from the magnet 87. This is achieved by a jerky movement of the wrist as heretofore described. This displaces the ball 86 and the arcuate portion of the side wall 85 will direct the ball into the chute 90 where the ball 86 will cause the contact arms 91 and 92 to contact each other and form a closed circuit.

Figure 10B:
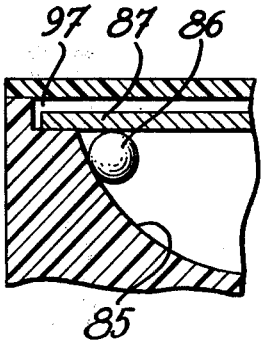

Referring now to FIG. 10B, there is shown a further modification of the present invention. Hereinshown, the magnet 87 is a plate-like element as is shown also in FIG. 10A but in this application, it is loosely retained in a cavity portion 97 of the side wall 85. As hereinshown, the cavity portion 97 is of a width greater than the width of the magnet 87 whereby the magnet 87 can be displaced vertically within the cavity 97. Also, the cavity 97 is slightly longer than the magnet 87 to facilitate this displacement and also causing a slight horizontal movement.

The advantage of the embodiment as shown in FIG. 10B is to provide a predetermined shock absorption when the spherical element 86 is magnetically retained to the magnet 87. Thus, the spherical element 86 will not be dislodged due to unwanted arm or wrist movements as the magnet 87 will be displaced with the element 86 magnetically retained thereto. With this type of an arrangement, it is possible to utilize magnets of less magnetic strength. Also, the percentage of false activation of the switch is minimized. Still further, the fact that the magnet is movable will also help in dislodging the spherical element 86 when the predetermined jerky movement is made, this movement acting transverse to the horizontal axis of the magnet 87.

I claim:

1. A switch device for use in a wristwatch, said device comprising a switch housing; a cavity defined within said switch housing; said cavity having a top wall, a bottom wall and a side wall with at least a portion thereof being arcuately extending; a spherical displaceable element, of magnetically attractable material located for movement within said cavity; said side wall, top wall and bottom wall being spaced apart a distance sufficient to permit free displacement of said displaceable element therebetween; at least one magnetic element associated with said cavity and located in a portion of said side wall whereby to retain said spherical displacement element thereto by magnetic attraction when said spherical element is displaced thereagainst in said cavity, said spherical element, when retained by said magnetic element, being dislodged therefrom by an external force created by a predetermined movement of a wearer's arm to release said spherical element in said cavity by gravity, and switch contact means in said arcuately extending portion of said side wall and actuable by said spherical displaceable element when in contact therewith and when said wristwatch is in a particular position.

2. A switch device as claimed in claim 1 wherein said cavity is a channel defined within the switch housing and extending at least in a portion thereof along an arcuate axis, said channel also having an inner side wall and an outer side wall defined by said cavity side wall, said magnetic element being located at an end of said channel.

3. A switch device as claimed in claim 1 wherein said spherical element is a ferrous metal ball.

4. A switch device as claimed in claim 2 wherein a plurality of spaced apart cavities are formed in at least said bottom wall in said channel whereby to retain said spherical element when positioned therein or to retard displacement of said spherical element when in movement in said channel.

5. A switch device as claimed in claim 2 wherein there are two magnetic elements, each said magnetic elements having a magnet secured to a support member which is connected to an adjustable cylinder whereby said magnet may be adjustably positioned within said channel to adjust the arcuate length of the channel between each said two magnetic elements and said switch contact means to adjust the sensitivity of said switch device.

6. A switch device as claimed in claim 1 wherein there is provided a hole in said outer side wall of said channel, said switch contact means being located across said hole and constituted by a pair of switch contact arms held in spaced apart relationship, said contact arms being brought in electrical contact with each other when said spherical element rests on one of said contact arms.

7. A switch device as claimed in claim 2 wherein there is provided a hole in said outer side wall of said channel, said switch contact means being located across said hole and constituted by a pair of switch contact arms held in spaced apart relationship, said contact arms being brought in electrical contact with each other when said spherical element rests on one of said contact arms.

8. A switch device as claimed in claim 6 wherein said hole is a cylindrical chute having one end defined by said hole in said outer side wall and a further end remote thereof, said further end having a threaded shank therein, one of said contacts being positioned above said threaded shank whereby said spacing between said contacts can be adjusted by displacing said shank.

9. A switch device as claimed in claim 6 wherein said switch housing is secured within a wristwatch casing with said hole in said outer side wall located along or parallel to the vertical axis of said casing and positioned towards the six o'clock designated position of a standard type watch dial having hour designations about the periphery of the dial.

10. A switch device as claimed in claim 9 wherein said switch housing is secured at angle with respect to the plane of said watch casing with said hole in said outer side wall lying closer to the rear of said watch.

11. A switch device as claimed in claim 1 wherein said magnetic element is a plate-like element loosely retained in a portion of said side wall whereby said magnetic element is movable in a horizontal and vertical plane in order to provide predetermined shock absorption with said spherical element magnetically retained thereto.

12. A switch device as claimed in claim 1 wherein there is provided a further magnetic element positioned adjacent said switch contact means on a side thereof opposite the side that said spherical displaceable element contacts whereby to attract said spherical element against said contact means.

* * * * *